US011162735B2

(12) United States Patent
Christians et al.

(10) Patent No.: US 11,162,735 B2
(45) Date of Patent: Nov. 2, 2021

(54) DISTRIBUTOR FOR FALLING FILM EVAPORATOR

(71) Applicant: Carrier Corporation, Farmington, CT (US)

(72) Inventors: Marcel Christians, Skaneateles, NY (US); Jack Leon Esformes, Jamesville, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 15/105,007

(22) PCT Filed: Oct. 22, 2014

(86) PCT No.: PCT/US2014/061705

§ 371 (c)(1),
(2) Date: Jun. 16, 2016

(87) PCT Pub. No.: WO2015/099872

PCT Pub. Date: Jul. 2, 2015

(65) Prior Publication Data

US 2016/0320136 A1 Nov. 3, 2016

Related U.S. Application Data

(60) Provisional application No. 61/920,514, filed on Dec. 24, 2013.

(51) Int. Cl.
*F28D 5/02* (2006.01)
*F28D 3/04* (2006.01)
(Continued)

(52) U.S. Cl.
CPC ..... *F28D 5/02* (2013.01); *F25B 39/028* (2013.01); *F28D 3/04* (2013.01); *F28F 9/02* (2013.01);
(Continued)

(58) Field of Classification Search
CPC ..... F28D 5/00; F28D 5/02; F28D 3/02; F28D 3/04; F25B 39/028; F25B 39/02;
(Continued)

(56) References Cited

U.S. PATENT DOCUMENTS 1,546,841 A * 7/1925 Kuhn ..... F25B 39/04 239/193
1,694,370 A * 12/1928 Lalor ..... F28D 3/02 62/394
(Continued)

FOREIGN PATENT DOCUMENTS

EP 1798506 A2 6/2007
EP 2236973 6/2010
(Continued)

OTHER PUBLICATIONS

Notification of Transmittal of the International Search Report and the Written Opinion of the International Searching Authority, or the Declaration; PCT/US2014/061705; dated Jan. 21, 2015; 9 pages.

*Primary Examiner* — Harry E Arant
(74) *Attorney, Agent, or Firm* — Cantor Colburn LLP

(57) ABSTRACT

A falling film evaporator includes a plurality of evaporator tubes through which a volume of thermal energy transfer medium is flowed, a separator to separate a flow of liquid refrigerant from a vapor and liquid refrigerant mixture, and a distributor operably connected to the separator to distribute a flow of liquid refrigerant over the plurality of evaporator tubes. The distributor includes a distributor inlet to receive the flow of liquid refrigerant from the separator, a sparge channel connected to the distributor inlet to flow the liquid refrigerant therethrough and exiting the sparge channel via a plurality of sparge openings in an upper surface of the sparge channel, and a distribution sheet disposed below the sparge channel through which the liquid refrigerant flows onto the plurality of evaporator tubes. A flow rate of liquid refrigerant through each sparge opening of the plurality of sparge openings is substantially equal.

16 Claims, 5 Drawing Sheets

(51) Int. Cl.
*F28F 9/02* (2006.01)
*F25B 39/02* (2006.01)

(52) U.S. Cl.
CPC .... *F28F 9/0273* (2013.01); *F25B 2339/0242* (2013.01); *F25B 2400/13* (2013.01); *F25B 2400/23* (2013.01)

(58) Field of Classification Search
CPC ..... F25B 2339/0242; F25B 2400/13; F25B 2400/23; F28F 9/02; F28F 27/02; F28F 9/22; F28F 25/00; F28F 2025/005; F28F 25/02; F28F 25/04; F28F 25/06; F28F 25/08; F28F 25/082; F28F 9/0273; B05B 1/265
See application file for complete search history.

(56) References Cited

U.S. PATENT DOCUMENTS 4,524,752 A * 6/1985 Clarke ..... F23C 3/002 126/91 A
4,815,533 A * 3/1989 Harada ..... F28D 7/16 165/154
5,588,596 A * 12/1996 Hartfield ..... B01D 1/04 165/117
6,293,112 B1 * 9/2001 Moeykens ..... F25B 39/02 165/115
6,868,695 B1 * 3/2005 Dingel ..... F25B 39/028 165/115
8,302,426 B2 * 11/2012 de Larminat ..... F25B 39/028 62/515
2004/0159121 A1 * 8/2004 Horiuchi ..... F25B 39/02 62/526
2010/0107676 A1 5/2010 Liu et al.
2013/0277019 A1 * 10/2013 Numata ..... F25B 39/02 165/157
2015/0013950 A1 * 1/2015 Numata ..... F25B 39/02 165/157

FOREIGN PATENT DOCUMENTS

JP 10267586 A 9/1998
WO 2013074749 A1 5/2013
WO 2013112818 A1 8/2013

* cited by examiner

DISTRIBUTOR FOR FALLING FILM EVAPORATOR

BACKGROUND

The subject matter disclosed herein relates to heating, ventilation and air conditioning (HVAC) systems. More specifically, the subject matter disclosed herein relates to falling film evaporators for HVAC systems.

HVAC systems, such as chillers, use an evaporator to facilitate a thermal energy exchange between a refrigerant in the evaporator and a medium flowing in a number of evaporator tubes positioned in the evaporator. In a flooded evaporator, the tubes are submerged in a pool of refrigerant. This results in a particularly high volume of refrigerant necessary, depending on a quantity and size of evaporator tubes, for efficient system operation. Another type of evaporator used in chiller systems is a falling film evaporator. In a falling film evaporator, the evaporator tubes are positioned typically below a distribution manifold from which refrigerant is urged, forming a "falling film" on the evaporator tubes.

In a typical falling film evaporator, an external knockout drum is used to separate liquid refrigerant from a liquid-vapor refrigerant mixture that enters the knockout drum. The liquid refrigerant is then drained from the drum and conveyed into the evaporator and distribution manifold via a piping network. The distribution manifold meters the flow of liquid refrigerant over the evaporator tubes. The distribution manifold, however, tends to lose static pressure in the liquid refrigerant as distance from a refrigerant inlet increases. This problem is typically addressed by having multiple refrigerant inlets to the distributor, which reduces a distance any portion of the distributor is from a refrigerant inlet. This results in a complex and expensive distributor.

BRIEF SUMMARY

In one embodiment, a heating, ventilation and air conditioning (HVAC) system includes a compressor flowing a flow of refrigerant therethrough and a falling film evaporator in flow communication with the compressor. The evaporator includes a plurality of evaporator tubes through which a volume of thermal energy transfer medium is flowed, a separator to separate a flow of liquid refrigerant from a vapor and liquid refrigerant mixture, and a distributor to distribute the flow of liquid refrigerant over the plurality of evaporator tubes. The distributor includes a distributor inlet to receive the flow of liquid refrigerant from the separator and a sparge channel connected to the distributor inlet to flow the liquid refrigerant therethrough and exiting the sparge channel via a plurality of sparge openings in an upper surface of the sparge channel. A distribution sheet is located below the sparge channel through which the liquid refrigerant flows onto the plurality of evaporator tubes. A flow rate of liquid refrigerant through each sparge opening of the plurality of sparge openings is substantially equal.

In another embodiment, a falling film evaporator includes a plurality of evaporator tubes through which a volume of thermal energy transfer medium is flowed, a separator to separate a flow of liquid refrigerant from a vapor and liquid refrigerant mixture, and a distributor operably connected to the separator to distribute a flow of liquid refrigerant over the plurality of evaporator tubes. The distributor includes a distributor inlet to receive the flow of liquid refrigerant from the separator, a sparge channel connected to the distributor inlet to flow the liquid refrigerant therethrough and exiting the sparge channel via a plurality of sparge openings in an upper surface of the sparge channel, and a distribution sheet disposed below the sparge channel through which the liquid refrigerant flows onto the plurality of evaporator tubes. A flow rate of liquid refrigerant through each sparge opening of the plurality of sparge openings is substantially equal.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

Figure 1:
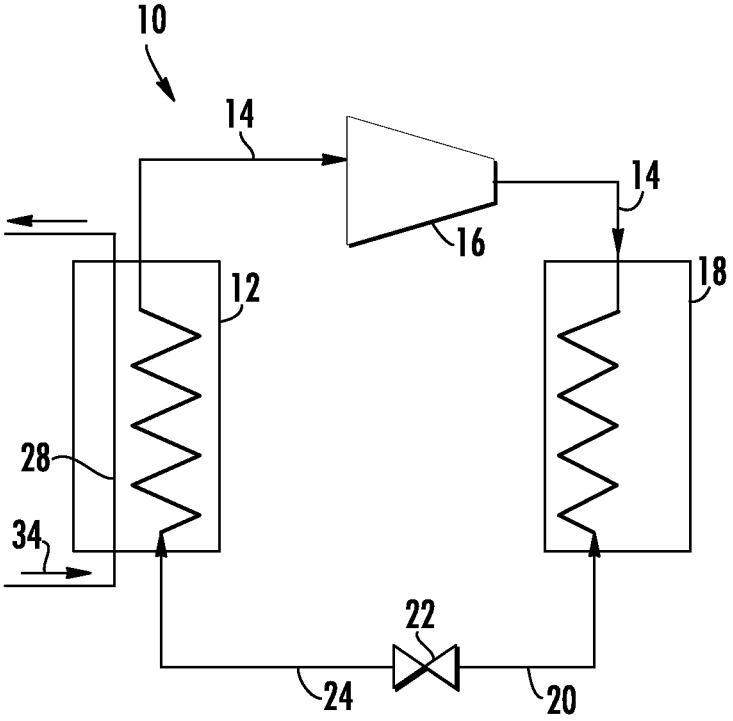
FIG. 1 is a schematic view of an embodiment of a heating, ventilation and air conditioning system.

The detailed description explains embodiments of the invention, together with advantages and features, by way of example with reference to the drawing.

DETAILED DESCRIPTION

Shown in FIG. 1 is a schematic view an embodiment of a heating, ventilation and air conditioning (HVAC) unit, for example, a chiller 10 utilizing a falling film evaporator 12. A flow of vapor refrigerant 14 is directed into a compressor 16 and then to a condenser 18 that outputs a flow of liquid refrigerant 20 to an expansion valve 22. The expansion valve 22 outputs a vapor and liquid refrigerant mixture 24 toward the evaporator 12.

Figure 2:
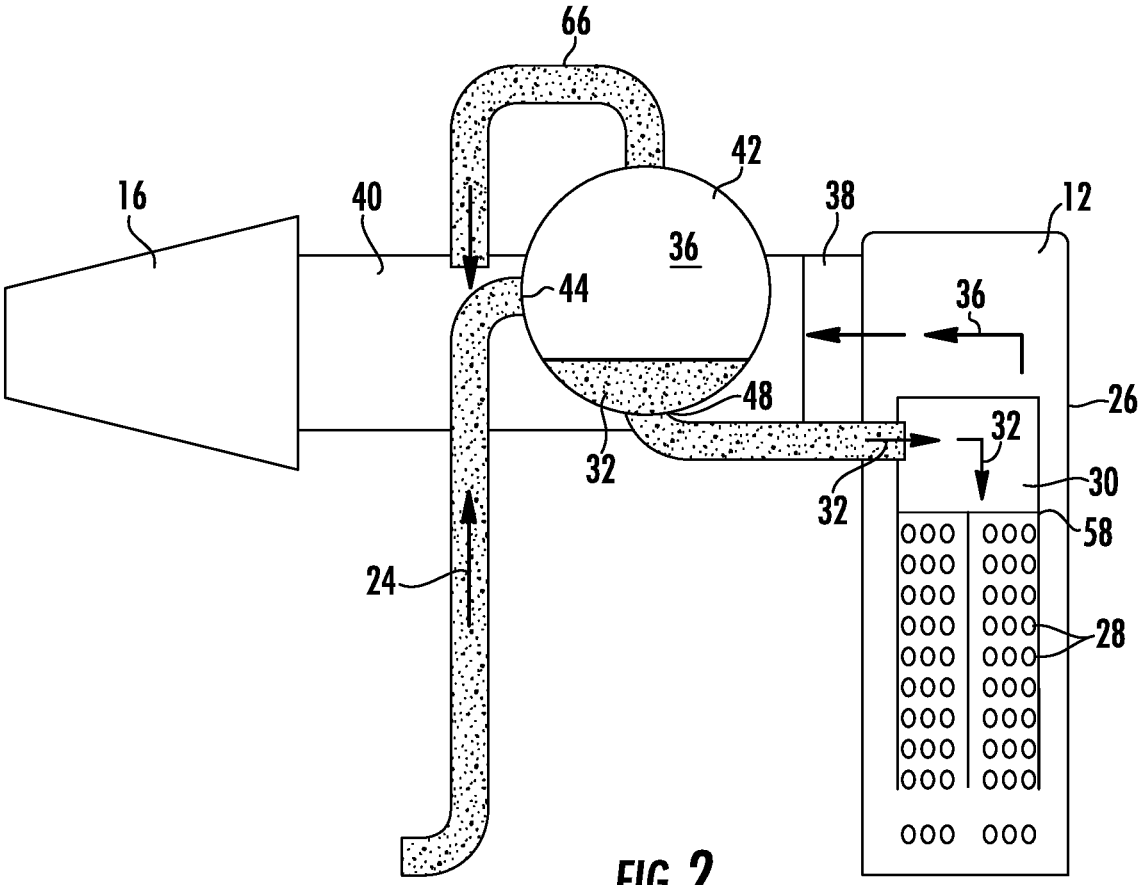
FIG. 2 is a schematic elevation view of an embodiment of a falling film evaporator.

Referring now to FIG. 2, as stated above, the evaporator 12 is a falling film evaporator. The evaporator 12 includes housing 26 with the evaporator 12 components disposed at least partially therein, including a plurality of evaporator tubes 28. A distributor 30 is located above the evaporator tubes 28 to distribute liquid refrigerant 32 over the evaporator tubes 28. A thermal energy exchange occurs between a flow of heat transfer medium 34 (shown in FIG. 1) flowing through the evaporator tubes 28 into and out of the evaporator 12 and the liquid refrigerant 32. As the liquid refrigerant 32 is boiled off in the evaporator 12, the resulting vapor refrigerant 36 is directed to the compressor 16 via a suction nozzle 38 and through a suction line 40, as shown in FIG. 3.

Referring again to FIG. 2, a separator 42 is upstream of the distributor 30 with a refrigerant inlet 44 for vapor and liquid refrigerant mixture 24 to enter the separator 42 from the expansion valve 22. The separator 42 may be located outside of the housing 26 as shown, or in other embodiments may be located inside of, or partially inside of the housing 26. The separator 42 separates the liquid refrigerant 32 from the vapor and liquid refrigerant mixture 24, resulting in a volume of vapor refrigerant 36 in the separator 42. A drain 48 is located at the separator 42 and connects the separator 42 to the distributor 30, so that liquid refrigerant 32 separated from the vapor and liquid refrigerant mixture 24 is flowed into the distributor 30 via the drain 48.

Figure 3:
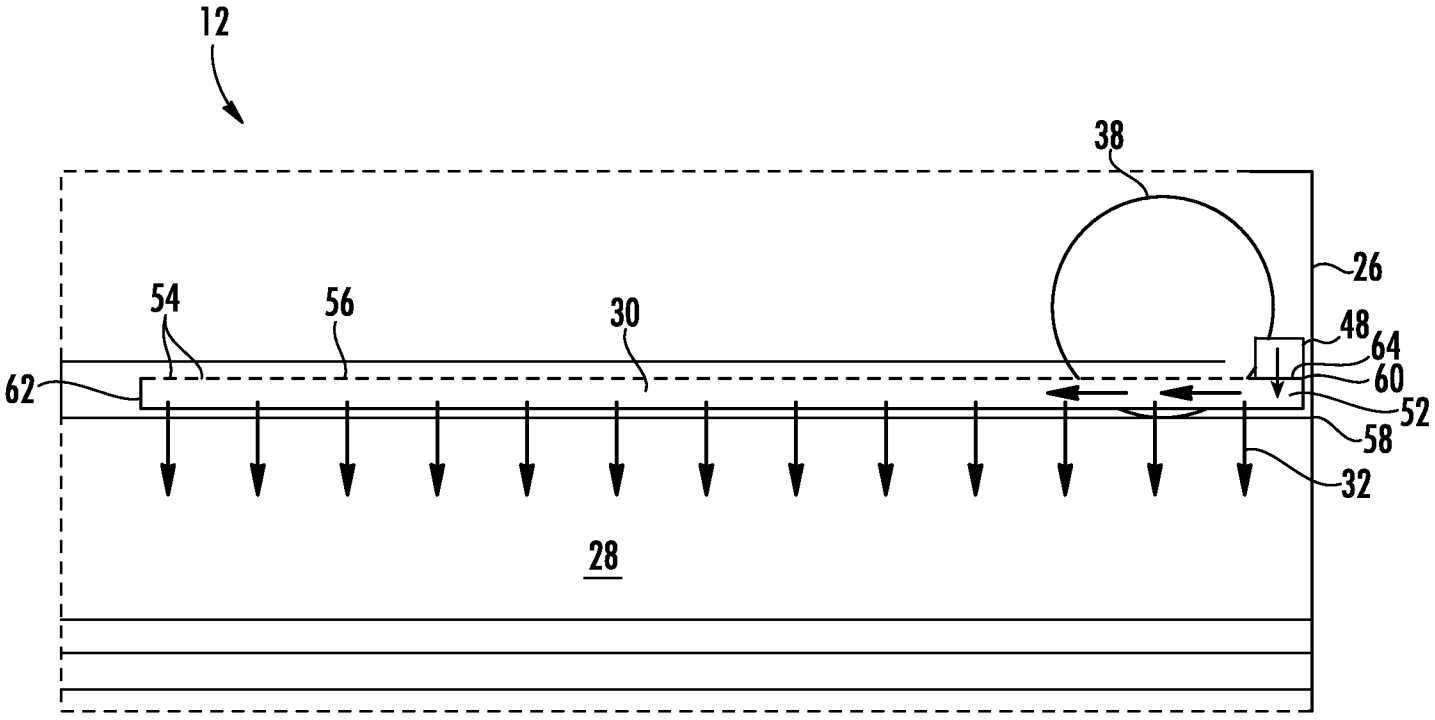
FIG. 3 is another schematic plan view of an embodiment of a falling film evaporator.
Figure 4:
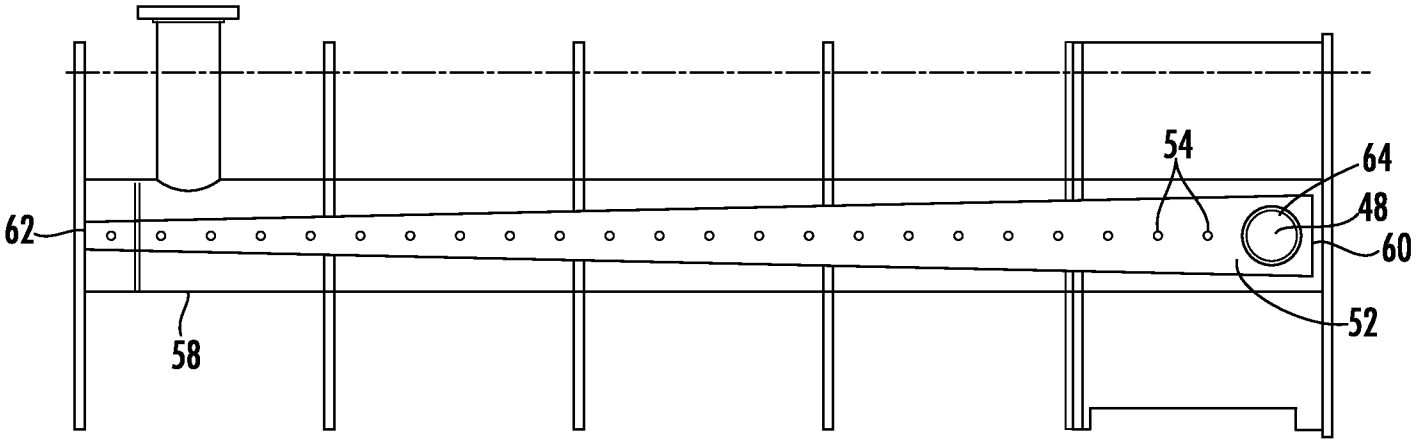
FIG. 4 is a top view of an embodiment of a distributor for a falling film evaporator.

Referring to FIG. 3, the liquid refrigerant 32 enters the distributor 30 via the drain 48 and flows into a sparge channel 52. Sparge openings 54 arranged on an upper portion 56 of the sparge channel 52 allow flow of the liquid refrigerant 32 out of the sparge channel 52 and through a distribution sheet 58 forming a falling film over the evaporator tubes 28. The liquid refrigerant 32 enters the distributor 30 at a first distributor end 60 and flows toward a second distributor end 62 opposite the first distributor end 60, specifically entering the sparge channel 52 located inside the distributor 30. The sparge channel 52 has a decreasing cross-sectional area as distance from a sparge channel inlet 64 increases and the sparge openings 54 are of equal diameters, or equal cross-sectional area. In doing so, the static pressure in the sparge channel 52 varies only slightly, thus the flow rate of liquid refrigerant 32 delivered through each of the sparge openings 54 is the same. It is to be appreciated that while a trapezoidal sparge channel 52 with a rectangular cross-section is shown, the same effect can be achieved via other configurations such as utilizing a conical round pipe as a sparge channel 52, or a sparge channel 52 having a constant cross-section with differently sized sparge openings 54, specifically sparge openings 54 having an increasing cross-sectional area as distance from the sparge channel inlet 64 increases. Further, it is to be appreciated that in other embodiments, the sparge channel inlet 64 is not located at a first distributor end 60, but may be located for example, at a center of the sparge channel 52. In such embodiments, the sparge channel 52 has decreasing a cross-sectional area in both directions, toward the first distributor end 60 and toward the second distributor end 62 as distance from the sparge channel inlet 64 increases.

Referring again to FIG. 2, remnants of the liquid and vapor refrigerant mixture 24 after separating the liquid refrigerant 32 therefrom comprises vapor refrigerant 36, which in the present application is defined as pure vapor refrigerant or vapor refrigerant with a volume of liquid refrigerant entrained therein. In some embodiments, the separator 42 has an efficiency of between 75% and about 99% in separation of the liquid refrigerant 32 from the vapor refrigerant 36. The vapor refrigerant 36 is routed from the separator 42 through a vent to compressor 16 via the suction line 40.

Figure 5:
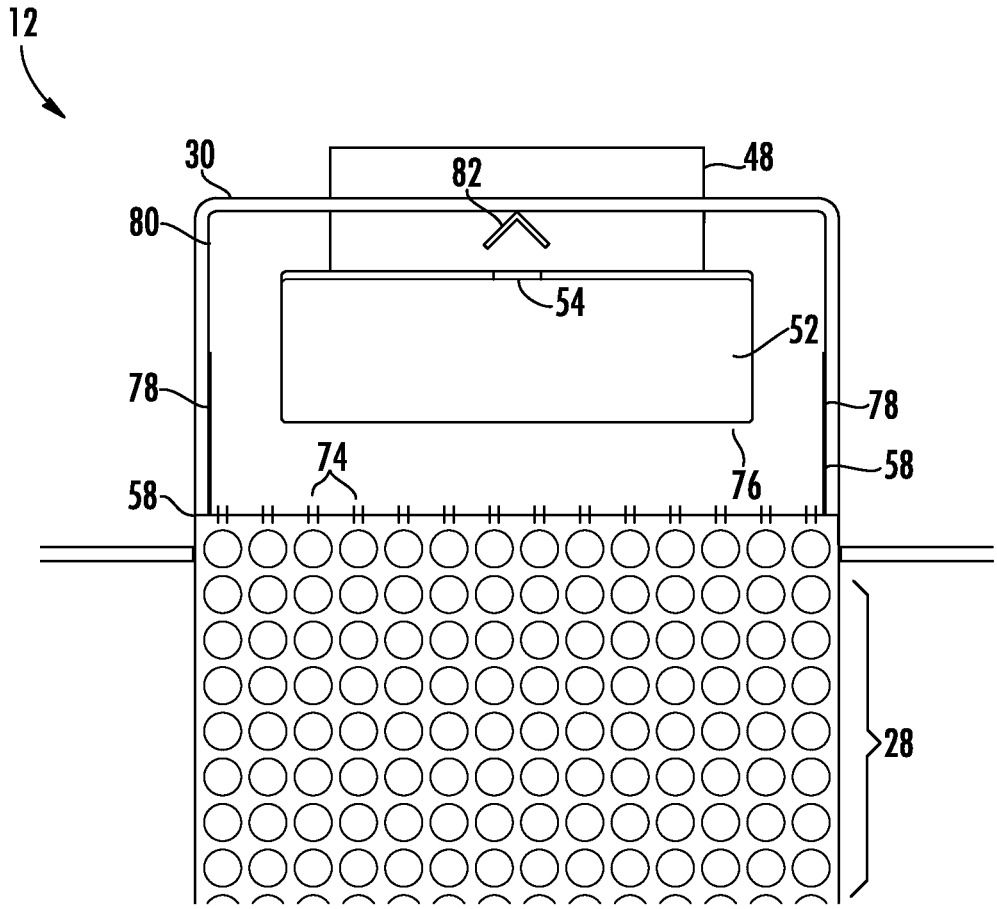
FIG. 5 is a cross-sectional view of an embodiment of a distributor for a falling film evaporator.

Referring now to FIG. 5, a construction of the distributor 30 will be discussed in more detail. The distributor 30 includes a distribution sheet 58 having a plurality of distribution openings 74 therein to distribute the liquid refrigerant 32 over the evaporator tubes 28. The distribution sheet 58 is formed from a C-channel shaped piece of sheet metal material. A plurality of support rods 76 extend across the distributor 30 between opposing walls 78 of the distribution sheet 58. The rods 76 support the sparge channel 52. A distributor box cover 80 is placed over the distribution sheet 58 and the sparge channel 52 to enclose the distributor 30. The cover 80 is formed from a complimentary piece of C-channel sheet metal. The sheet metal assembly construction is possible for the distributor 30 because of the low level of liquid refrigerant 32 head utilized by the system. In some embodiments, a target baffle 82 is positioned over the sparge openings 54 to redirect the liquid refrigerant 32 exiting the sparge openings 54 toward the distribution sheet 58.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A heating, ventilation and air conditioning (HVAC) system comprising:

a compressor flowing a flow of refrigerant therethrough;

a falling film evaporator in flow communication with the compressor including:

a plurality of evaporator tubes through which a volume of thermal energy transfer medium is flowed;

a separator to separate a flow of liquid refrigerant from a vapor and liquid refrigerant mixture; and a distributor to distribute the flow of liquid refrigerant over the plurality of evaporator tubes, the distributor including:

a distributor inlet to receive the flow of liquid refrigerant from the separator;

a sparge channel connected to the distributor inlet to flow the liquid refrigerant therethrough and exiting the sparge channel via a plurality of sparge openings in an upper surface of the sparge channel, the distributor inlet connected to the sparge channel at a first end of the sparge channel, the plurality of sparge openings arrayed between the distributor inlet and a second end of the sparge channel opposite the first end;

a distribution sheet disposed below the sparge channel through which the liquid refrigerant flows onto the plurality of evaporator tubes, the distribution sheet formed from a C-channel shaped piece of sheet metal material; and a distributor box cover placed over the distribution sheet and the sparge channel to enclose the distributor, the distributor box cover formed from a complimentary piece of C-channel sheet metal to define a distributor having a closed rectangular cross-section;

wherein opposing sidewalls of the distribution sheet extend upwardly from a distribution sheet base toward a top surface of the distributor box cover and are installed between and vertically overlap opposing sidewalls of the distributor box cover; and wherein the plurality of sparge opening are configured such that a flow rate of liquid refrigerant through each sparge opening of the plurality of sparge openings is equal; and a target baffle disposed vertically over the plurality of sparge openings, the target baffle configured to redirect the flow of liquid refrigerant downwardly toward the distribution sheet, the target baffle secured to an interior wall of the distributor box cover.

2. The HVAC system of claim 1, wherein the sparge channel has a decreasing channel cross-sectional area with increasing distance from the distributor inlet.

3. The HVAC system of claim 2, wherein the channel cross-section is rectangular.

4. The HVAC system of claim 2, wherein the plurality of sparge openings have an equal cross-sectional area.

5. The HVAC system of claim 1, wherein a sparge opening cross-sectional area increases with increasing distance from the distributor inlet.

6. The HVAC system of claim 1, wherein the sparge channel is supported by a plurality of support rods extending between opposing walls of the distributor.

7. The HVAC system of claim 1, wherein the distribution sheet includes a flat, planar sheet base including a plurality of distribution openings through which the liquid refrigerant flows onto the plurality of evaporator tubes.

8. A falling film evaporator comprising:

a plurality of evaporator tubes through which a volume of thermal energy transfer medium is flowed;

a separator to separate a flow of liquid refrigerant from a vapor and liquid refrigerant mixture;

a distributor operably connected to the separator to distribute a flow of liquid refrigerant over the plurality of evaporator tubes, the distributor including:

a distributor inlet to receive the flow of liquid refrigerant from the separator;

a sparge channel connected to the distributor inlet to flow the liquid refrigerant therethrough and exiting the sparge channel via a plurality of sparge openings in an upper surface of the sparge channel, the distributor inlet connected to the sparge channel at a first end of the sparge channel, the plurality of sparge openings arrayed between the distributor inlet and a second end of the sparge channel opposite the first end;

a distribution sheet disposed below the sparge channel through which the liquid refrigerant flows onto the plurality of evaporator tubes, the distribution sheet formed from a C-channel shaped piece of sheet metal material; and a distributor box cover placed over the distribution sheet and the sparge channel to enclose the distributor, the distributor box cover formed from a complimentary piece of C-channel sheet metal to define a distributor having a closed rectangular cross-section;

wherein opposing sidewalls of the distribution sheet extend upwardly from a distribution sheet base toward a top surface of the distributor box cover and are installed between and vertically overlap opposing sidewalls of the distributor box cover; and wherein the plurality of sparge opening are configured such that a flow rate of liquid refrigerant through each sparge opening of the plurality of sparge openings is equal; and a target baffle disposed vertically over the plurality of sparge openings, the target baffle configured to redirect the flow of liquid refrigerant downwardly toward the distribution sheet, the target baffle secured to an interior wall of the distributor box cover.

9. The evaporator of claim 8, wherein the sparge channel has a decreasing channel cross-sectional area with increasing distance from the distributor inlet.

10. The evaporator of claim 9, wherein the channel cross-section is rectangular.

11. The evaporator of claim 9, wherein the plurality of sparge openings have an equal cross-sectional area.

12. The evaporator of claim 8, wherein a sparge opening cross-sectional area increases with increasing distance from the distributor inlet.

13. The evaporator of claim 8, wherein the sparge channel is supported by a plurality of support rods extending between opposing walls of the distributor.

14. The evaporator of claim 8, wherein the distribution sheet includes a flat, planar sheet base including a plurality of distribution openings through which the liquid refrigerant flows onto the plurality of evaporator tubes.

15. A falling film evaporator comprising:

a plurality of evaporator tubes through which a volume of thermal energy transfer medium is flowed;

a separator to separate a flow of liquid refrigerant from a vapor and liquid refrigerant mixture;

a distributor operably connected to the separator to distribute a flow of liquid refrigerant over the plurality of evaporator tubes, the distributor including:

a distributor inlet to receive the flow of liquid refrigerant from the separator;

a sparge channel connected to the distributor inlet to flow the liquid refrigerant therethrough and exiting the sparge channel via a plurality of sparge openings in an upper surface of the sparge channel, the plurality of sparge openings having an equal cross-section, the sparge channel has a decreasing channel cross-sectional area with increasing distance from the distributor inlet, the distributor inlet connected to the sparge channel at a first end of the sparge channel, the plurality of sparge openings arrayed between the distributor inlet and a second end of the sparge channel opposite the first end; and a distribution sheet disposed below the sparge channel through which the liquid refrigerant flows onto the plurality of evaporator tubes, the distribution sheet including a flat, planar sheet base including a plurality of distribution openings through which the liquid refrigerant flows onto the plurality of evaporator tubes, the distribution sheet formed from a C-channel shaped piece of sheet metal material; and a distributor box cover placed over the distribution sheet and the sparge channel to enclose the distributor, the distributor box cover formed from a complimentary piece of C-channel sheet metal to define a distributor having a closed rectangular cross-section;

wherein opposing sidewalls of the distribution sheet extend upwardly from a distribution sheet base toward a top surface of the distributor box cover and are installed between and vertically overlap opposing sidewalls of the distributor box cover; and wherein the plurality of sparge opening are configured such that a flow rate of liquid refrigerant through each sparge opening of the plurality of sparge openings is equal; and a target baffle disposed vertically over the plurality of sparge openings, the target baffle configured to redirect the flow of liquid refrigerant downwardly toward the distribution sheet, the target baffle secured to an interior wall of the distributor box cover.

16. The falling film evaporator of claim 15, wherein the target baffle has a V-shaped cross-section.

* * * * *